US008807030B2

(12) United States Patent
Kölling et al.

(10) Patent No.: US 8,807,030 B2
(45) Date of Patent: Aug. 19, 2014

(54) CLAMPING DEVICE FOR PRINTING CYLINDER

(75) Inventors: Klaus Kölling, Krailling (DE); Christoph Gschossmann, Krailling (DE)

(73) Assignee: Kasper Walter GmbH & Co. KG, Krailling (DE)

( * ) Notice: Subject to any disclaimer, the term of this patent is extended or adjusted under 35 U.S.C. 154(b) by 1271 days.

(21) Appl. No.: 12/309,457

(22) PCT Filed: Jul. 18, 2007

(86) PCT No.: PCT/EP2007/006389
§ 371 (c)(1),
(2), (4) Date: Jan. 16, 2009

(87) PCT Pub. No.: WO2008/009439
PCT Pub. Date: Jan. 24, 2008

(65) Prior Publication Data

US 2009/0314172 A1 Dec. 24, 2009

(30) Foreign Application Priority Data

Jul. 19, 2006 (DE) ..... 10 2006 033 449

(51) Int. Cl.
*C25D 7/04* (2006.01)

(52) U.S. Cl.
USPC ..... 101/480; 101/378; 101/216

(58) Field of Classification Search
CPC ..... C25D 17/06; C25D 7/04
USPC ..... 101/480, 216, 378; 429/47; 205/151
IPC ..... C25D 17/06,17/08, 7/04; B41F 13/10
See application file for complete search history.

(56) References Cited

FOREIGN PATENT DOCUMENTS

| | | | |
|---|---|---|---|
| DE | 101 21 937 | | 11/2002 |
| DE | 10 2004 033332 | | 2/2006 |
| EP | 82268 | A1 * | 6/1983 |
| EP | 0 596 399 | | 5/1994 |
| JP | 06-220687 | | 8/1994 |
| JP | 10-110296 | | 4/1998 |
| WO | WO 2006005549 | A2 * | 1/2006 |

* cited by examiner

*Primary Examiner* — Judy Nguyen
*Assistant Examiner* — Jennifer Simmons
(74) *Attorney, Agent, or Firm* — D. Peter Hochberg; Sean F. Mellino; Richard A. Wolf

(57) ABSTRACT

A clamping device for a printing cylinder with two holders arranged on a joint axis, the holders each having a recess for receiving one end of the printing cylinder and being arranged with their recesses oriented towards each other and positioned adjustably to each other, with at least one of the recesses having a contact surface on which the allocated end of the printing cylinder is held during clamping. At least one of the holders comprises a carrier and a contact element fastened on the carrier on which the contact surface is formed. The contact element comprises a material which has a higher current conductivity and/or thermal conductivity than steel. In particular, copper or a copper alloy is suitable as a material for the contact element.

12 Claims, 3 Drawing Sheets

Fig. 1 – Prior Art

CLAMPING DEVICE FOR PRINTING CYLINDER

This application is a National Stage application of International Application No. PCT/EP2007/006389, filed on Jul. 18, 2007 and claims priority of German Application Serial No. 10 2006 033 449.3 filed Jul. 19, 2006.

BACKGROUND OF THE INVENTION

1. Field of the Invention

The invention relates to a clamping device for a printing cylinder for transmitting higher current volumes.

2. Description of the Prior Art

Such a clamping device is known from EP 0 596 399 A1 which is used to hold especially gravure cylinders—e.g. for printing publications—in galvanic plating. For this, the ends of the gravure cylinders are clamped between two hollow cones used as holders, oriented towards each other.

FIG. 1 shows a hollow cone described in EP 0 596 399 A1 which serves as holder 1 and is built into a galvanic plant in the manner described in EP 0 596 399 A1. Holder 1 is shown in a section in FIG. 1*a*), in a front view in FIG. 1*b*), and in a perspective view in FIG. 1*c*). For clarification, one axis end 2 of a printing cylinder is drawn in a broken line. FIG. 1*a*) clearly shows that current from holder 1 can be transmitted exclusively over an edge 3 of a front face of the axis end 2 because a contact exists only there. The high current required for electroplating is then transmitted via the hollow cones (holder 1) and the edges 3 contacting them on the front faces of the axis ends 2 into the printing cylinder. With an end diameter of approx. 100 mm and an essentially uniform distribution of current over the left and the right axis end 2, it is possible to feed up to approx. 14,000 A into the printing cylinder.

For these current volumes, the solution described in EP 0 596 399 A1 proved to be excellent. However, the development of larger gravure cylinders with a larger body width and the use of galvanic baths with higher immersion degrees of up to 100% resulted in the need for transmitting yet significantly higher currents—especially for chrome-plating—into the gravure cylinders to obtain economic processing times.

With such high current volumes, however, there is a risk of overheating of the hollow cones holding the axis ends which may result, at its worst, in burn marks on the hardened surface of the hollow steel cone, in melting insulating bushes, and in electric arcs.

The clamping device described in DE 101 21 937 A1 also does not enable the transmission of higher currents than so far.

DE 10 2004 033 332 A1 shows another clamping device in which the hollow cones have an inside contour with three holding surfaces offset from each other on which the respectively allocated end of the printing cylinder is held upon clamping. The three holding surfaces offset from each other present a kind of tripod from which the allocated axis end can be clamped in, similar to the way of a three-jaw chuck.

SUMMARY OF THE INVENTION

This invention has the object of providing a clamping device for a printing cylinder by means of which improved contacting can be obtained between the axis end of the printing cylinder and the allocated holder to transmit higher current volumes.

In accordance with the invention, this problem is solved by a clamping device according to patent claim 1. Advantageous developments of the invention are defined in the dependent claims.

A clamping device according to the invention for a printing cylinder with two holders arranged on a joint axis—the holders each having a recess for receiving one end of the printing cylinder and being arranged with their recesses oriented towards each other and positioned adjustably to each other and with at least one of the recesses having a contact surface on which the allocated end of the printing cylinder is held during clamping—is characterized in that at least one of the holders comprises a carrier and a contact element fastened on the carrier, that the contact surface is formed on the contact element, and that the contact element comprises a material which has a higher current conductivity and/or thermal conductivity than steel. The material of the contact element may be, in particular, copper or a copper-containing alloy, such as brass, bronze or hard-drawn copper while the carrier material is made of steel.

It is usual for the state of the art to manufacture entirely of steel the hollow cone known e.g. from EP 0 596 399 A1. Additionally, the conical surface is hardened to prevent wear and tear effects. It is to be taken into account that the axis ends of the printing cylinder are clamped in with high axial force which results in high surface pressures on the circular contact surfaces. It was assumed that the high surface pressures might damage the conical inside contour of the hollow cone which would reduce the life of the hollow cones. Hardening of the surface was to achieve a higher service life.

The invention here follows a different route: According to it, the contact element which e.g. forms a hollow cone is to be entirely made of copper and thus is to present a solid copper part. It is accepted that copper is considerably softer than steel and that—due to the surface pressure on the clamped edge of the axis end—local deformations in the contact surface are unavoidable. The at least microscopic deformation of the contact surface achieves that the contact element somewhat hugs the edge of the axis end and thus provides better, more planar contacting. The high current conductivity of copper ensures a large current volume which can be transmitted to the printing cylinder. Due to the good thermal conductivity of copper, the substantial heat is discharged well which develops in the contact area between the contact element and the axis end upon current flow. Any burn-in is thus prevented.

The improved contacting—due to the material softness of copper—at the edge of the axis end not only brings about that higher current volumes can be transmitted. Moreover, there is also a reduction in the occurrence of electric arcs which might possibly damage the axis end of the printing cylinder or the contact element.

The contact surface may form a cone-shaped or a spherical segment type inside contour as known e.g. from EP 0 596 399 A1 or DE 101 21 937 A1. It is simple to put into practice in this design that the axis ends are caught due to the holders being adjusted to each other and that the printing cylinder can be held firmly. The cone-shaped or spherical segment type inside contour furthermore allows axis ends with different diameters to be taken up without the contact element having to be adjusted or replaced.

A tension ring may be provided for clamping the contact element on the carrier. The contact element comprising copper can thus be very easily fastened on the steel carrier by the tension ring which is designed similar to a union plate or cap nut. The contact element may be held on the carrier solely by the clamping effect of the tension ring. Additional fastening of the contact element is not required, yet it is possible, e.g. by screwing.

If the contact surface is worn or, respectively, damaged after prolonged use, the entire contact element can simply be replaced. The steel carrier, however, remains on the clamping device. A new contact element can then be fastened again on the carrier with the aid of the tension ring. It is not always necessary, however, to completely replace the contact element. The contact surface could just as well also be machined to remove grooves, burs or damages.

The contact element made of copper is planarly held on the steel carrier by the steel tension ring so that no excessive local surface pressure occurs in the fastening area. Due to the tension ring, it is not necessary to have screws or other fastening elements directly act upon the copper contact element. It is thus possible to reliably fasten the contact element without any local damages occurring—e.g. due to screw heads when tightening screws.

These and other advantages and features are explained below in more detail on the basis of embodiments with the aid of the accompanying figures.

BRIEF DESCRIPTION OF THE DRAWINGS

Hereinafter, the invention is described in more detail by means of the drawings wherein.

DETAILED DESCRIPTION OF THE PREFERRED EMBODIMENT

Figure 2:
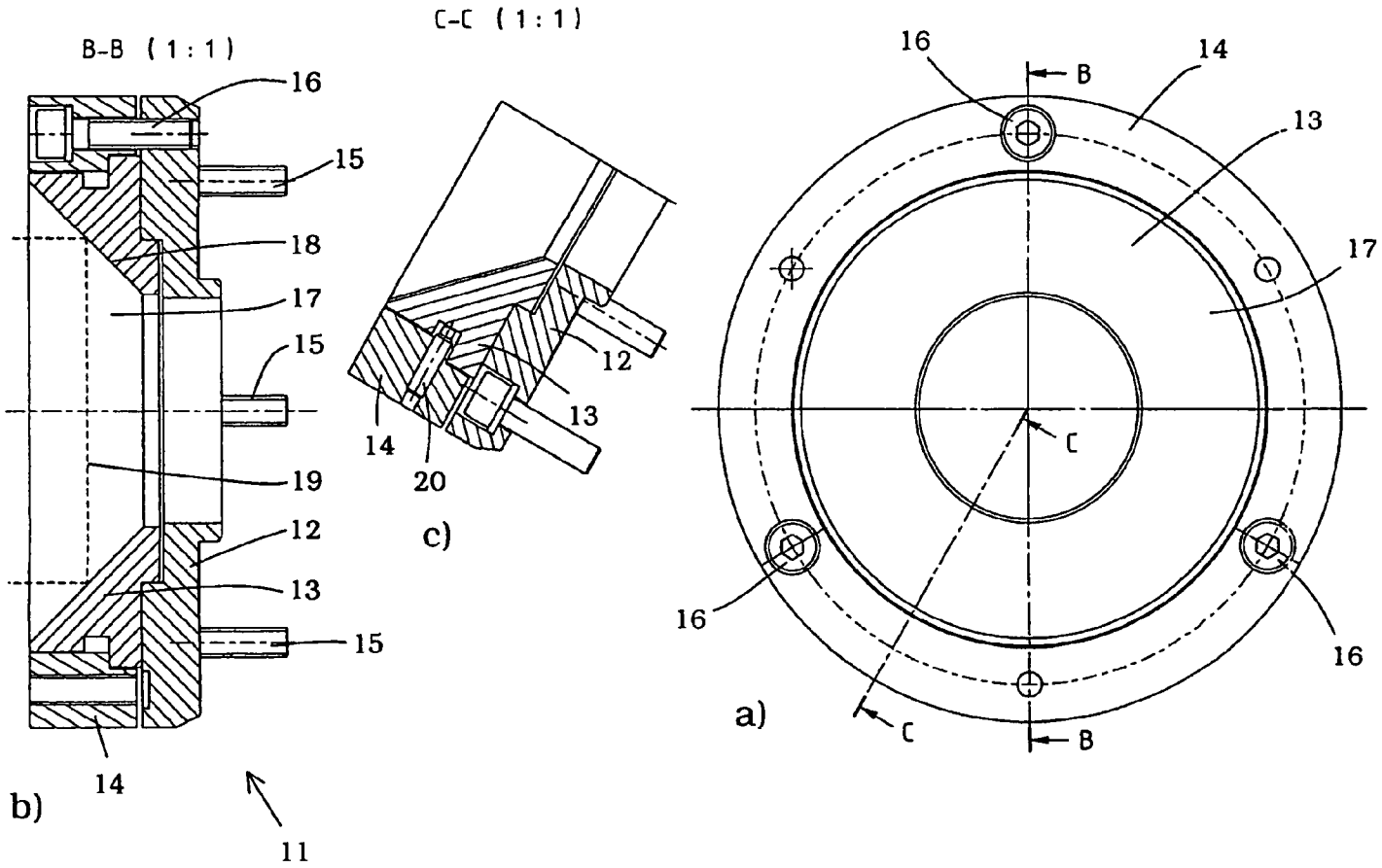
FIG. 2 is a holder according to the invention, in a front view (a), a section (b), and a partial section (c)

FIG. 2 shows a holder 11 according to the invention which can be fastened on a bearing bridge later to be described in connection with FIG. 3.

Figure 1:
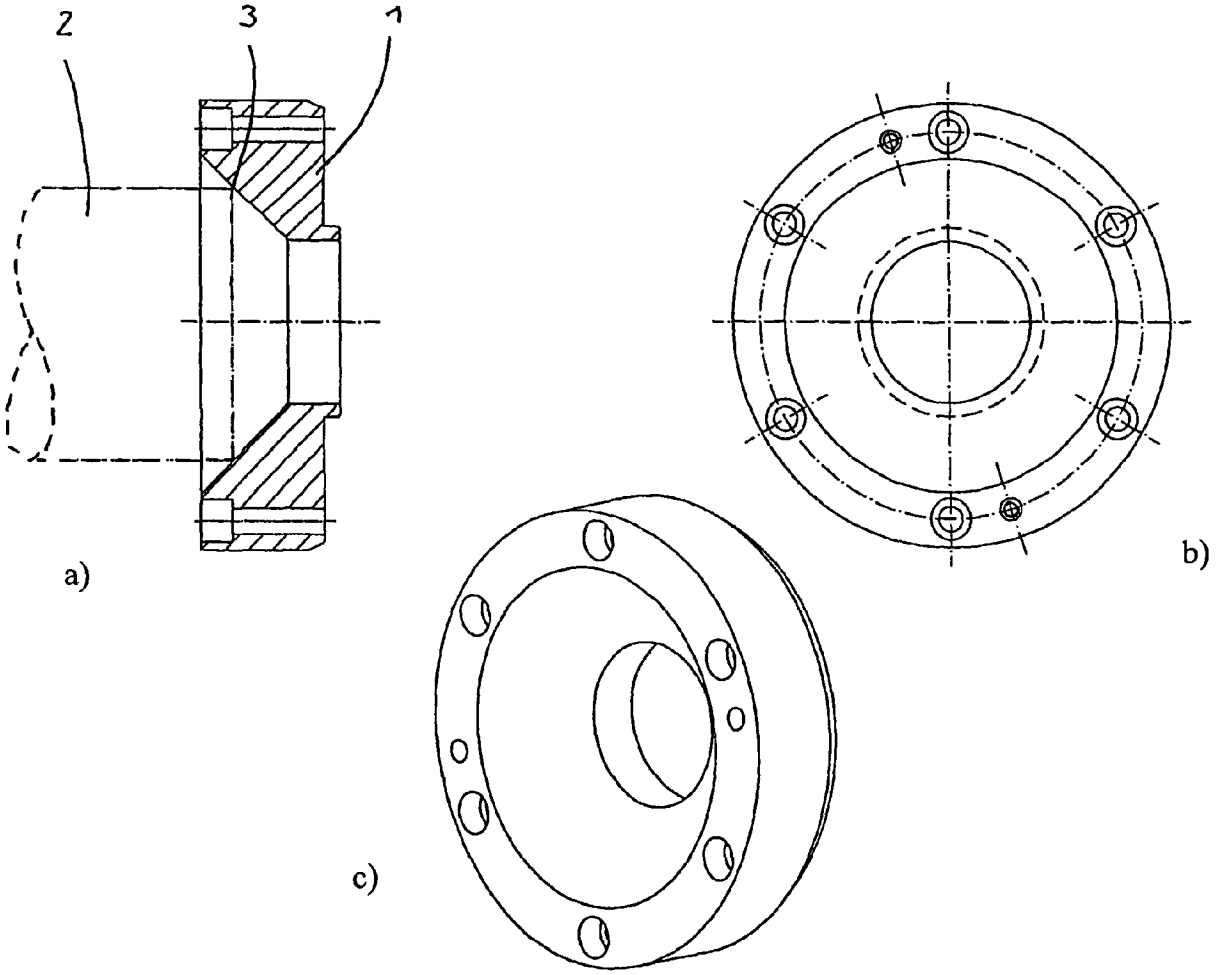
FIG. 1 is a holder known from the state of the art, in a section (a), a front view (b), and a perspective view (c)

With regard to its function, the holder 11 is essentially equivalent to the holder 1 described above in FIG. 1 with reference to the state of the art. Opposite holder 11 and arranged on a joint axis, a second holder not shown is arranged so that the printing cylinder can be clamped in with its two axis ends between the two holders 11. The holders 11 are adjustable to each other via the bearing bridge so that the necessary clamping pressure can be generated.

The holder 11 comprises a carrier 12 and a contact element 13 which is held by means of a tension ring 14 on the carrier 12. The carrier 12 is screwed onto the bearing bridge with the aid of screws 15.

The tension ring 14 is fastened with screws 16 on the carrier 12 and thus clamps the contact element 13 against the carrier 12.

The contact element 13 comprises a recess 17 which forms a contact surface 18 with a cone-shaped inside contour. In this manner, the contact element 13 forms a hollow cone in the manner described in EP 0 596 399 A1.

Instead of a conical inside contour, other contours may also be used, such as a spherical segment type inside contour.

The carrier 12 conventionally comprises steel. The contact element 13, however, is manufactured of solid copper or a copper alloy. This ensures high current transmission and good thermal discharge. Due to the planar contact between the contact element 13 and the carrier 12 which is effected by the tension ring 14, it is ensured that the current introduced via the carrier 12 can be transmitted to the contact element 13 and thus to the printing cylinder. One axis end 19 of the printing cylinder is presented stylized using a dashed and dotted line.

FIG. 2*c*) is a partial section along line C-C in FIG. 2*a*). A centering pin 20 is here visible by means of which the relative position between the contact element 13 and the carrier 12 is form-fittingly defined.

Figure 3:
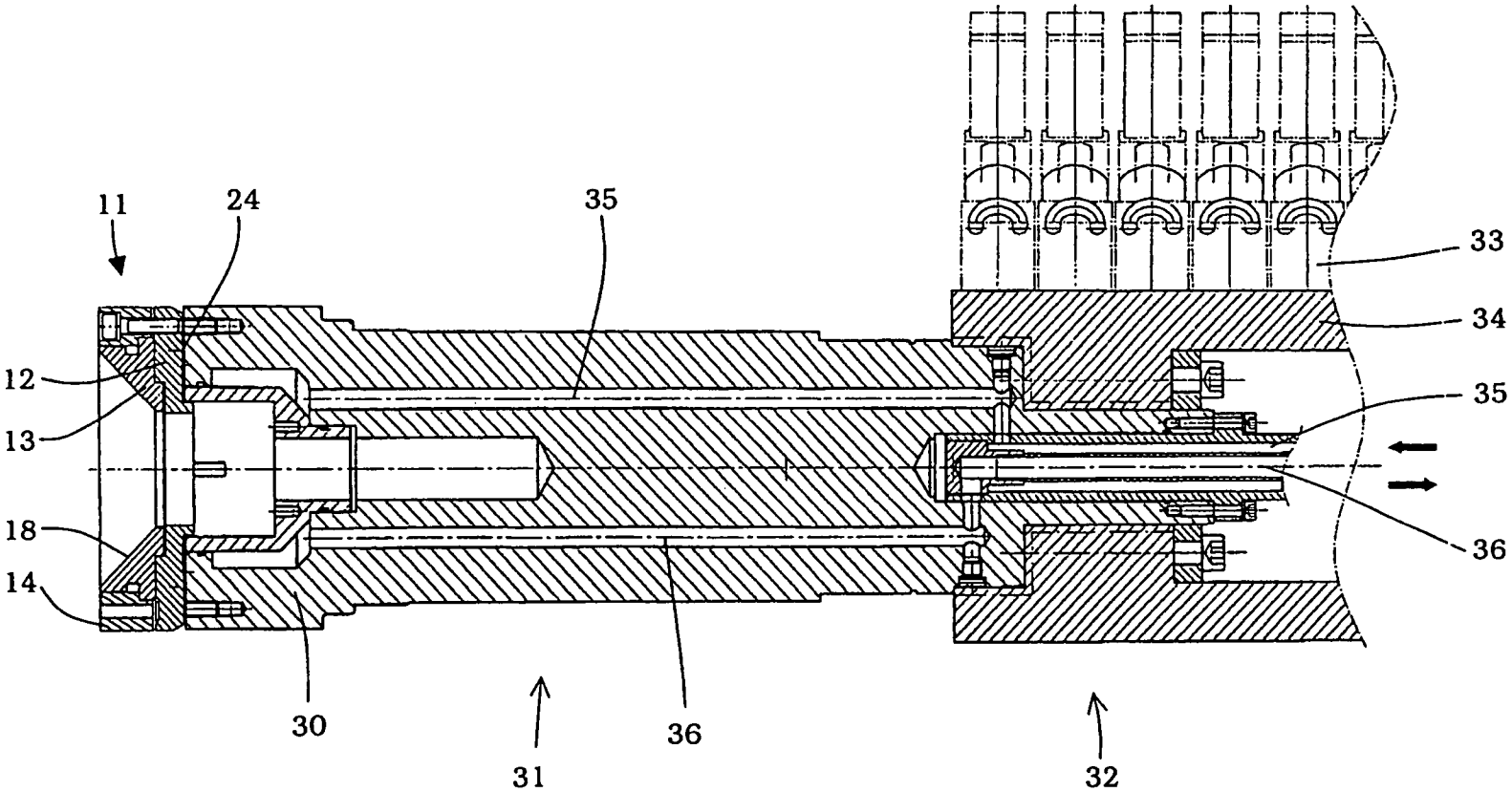
FIG. 3 is a section of one part of a bearing bridge with the holder according to the invention.

FIG. 3 is a section of one part of a bearing bridge onto which the holder 11 according to the invention is screwed. A second bearing bridge is allocated—coaxially opposite in the galvanic plant—to the bearing bridge shown in FIG. 3 so that the printing cylinder not shown can be axially clamped between the two bearing bridges.

The holder 11 is screwed onto a shaft 30 which is pivoted in a bearing 31 in a known manner not shown. Opposite the holder 11, a current transmission area 32 is provided in which water-cooled carbon brushes 33 introduce the galvanizing current into a slip ring 34 from where the current is transmitted via the shaft 30 and the holder 11 to the printing cylinder.

At the bearing 31, the shaft 30 is fit into the actual bearing bridge which, in the end, holds the printing cylinder or, respectively, drives it rotatably.

Cooling ducts 35 and 36 run through the shaft 30 and cooling water can be pumped through them. This cooling circuit also cools the front part of shaft 30 which carries the holder 11. Since the contact element 13 exhibits particularly good thermal conductivity, it dissipates heat from the contact surface 18 to the carrier 12, and then the heat is transmitted to the shaft 30 from the carrier 12 to a surface 24 of the shaft 30 which contacts the carrier 12 as shown in FIG. 3. From there, heat can be reliably discharged with the cooling circuit formed by the cooling ducts 35, 36.

The design shown in FIG. 3 presents one part of a bearing bridge known per se so that any further description is unnecessary.

Having described preferred methods of putting the invention into effect, it will be apparent to those skilled in the art to which this invention relates, that modifications and amendments to various features and items can be effected and yet still come within the general concept of the invention. It is to be understood that all such modifications and amendments are intended to be included within the scope of the present invention.

The invention claimed is:

1. Clamping device for a printing cylinder, said printing cylinder having two opposite ends, said clamping device comprising:

two holders arranged on a joint axis, the holders each having a recess for receiving opposite ends of the printing cylinder, said holders being arranged with their respective recesses oriented towards each other and positioned adjustably to each other;

at least one of the holders comprising a carrier and a contact element fastened on the carrier;

the contact element continuously engaging the printing cylinder without any disruptions between the contact element and the printing cylinder for holding one end of the printing cylinder during clamping of the printing cylinder, and excluding any other material associated with said contact element from directly contacting the printing cylinder, the contact element consisting of a material having a higher current conductivity or a higher thermal conductivity than steel.

2. Clamping device according to claim 1, wherein the material of the contact element comprises copper or a copper-containing alloy.

3. Clamping device according to claim 1 wherein the material of the carrier comprises steel.

4. Clamping device according to claim 1 further comprising a tension ring for clamping the contact element on the carrier.

5. Clamping device according to claim 4 wherein said tension ring has a clamping effect for solely holding the contact element on the carrier.

6. Clamping device according to claim 1, wherein the contact element comprises a cone-shaped or spherical segment type inside contour.

7. Clamping device for a printing cylinder, said printing cylinder having two opposite ends, said clamping device comprising:

two holders arranged on a joint axis, the holders each having a recess for receiving opposite ends of the printing cylinder, said holders being arranged with their respective recesses oriented towards each other and positioned adjustably to each other;

at least one of the holders comprising a carrier and a contact element fastened on the carrier;

the contact element continuously engaging the printing cylinder without any disruptions between the contact element and the printing cylinder for holding one end of the printing cylinder during clamping of the printing cylinder, and excluding any other material associated with said contact element from directly contacting the printing cylinder, the contact element consisting of a material having a higher current conductivity and a higher thermal conductivity than steel.

8. Clamping device according to claim 7, wherein the material of the contact element comprises copper or a copper-containing alloy.

9. Clamping device according to claim 7 wherein the material of the carrier comprises steel.

10. Clamping device according to claim 7 further comprising a tension ring for clamping the contact element on the carrier.

11. Clamping device according to claim 10 wherein said tension ring has a clamping effect for solely holding the contact element on the carrier.

12. Clamping device according to claim 7, wherein the contact element comprises a cone-shaped or spherical segment type inside contour.

* * * * *